US005905329A

United States Patent [19]

Thomas et al.

[11] Patent Number: 5,905,329

[45] Date of Patent: May 18, 1999

[54] LAMP BASE HOUSING, WITH GEMINAL HALVES CONFIGURED TO ENGAGE A PRESS SEAL

[75] Inventors: Ronald E. Thomas, Warren; Michael J. Bonavita, Russell; Steven M. Boyd, Waren, all of Pa.

[73] Assignee: Osram Sylvania Inc., Danvers, Mass.

[21] Appl. No.: 08/844,479

[22] Filed: Apr. 18, 1997

[51] Int. Cl.[6] ..... H01J 5/60

[52] U.S. Cl. ..... 313/318.01; 362/221; 362/83.3

[58] Field of Search ..... 313/318.01, 318.02, 313/318.09, 318.1; 362/83.3, 221

[56] References Cited

U.S. PATENT DOCUMENTS 3,898,495 8/1975 Livera ..... 313/318.09

FOREIGN PATENT DOCUMENTS 363218117 9/1988 Japan ..... 313/318.02

*Primary Examiner*—Sandra O'Shea
*Assistant Examiner*—Matthew J. Gerike
*Attorney, Agent, or Firm*—William H. McNeill

[57] ABSTRACT

A lamp assembly is provided which includes a lamp, a lamp base attached to the lamp, and a lamp heater. One or more abutment regions of the lamp and the lamp base mate with one another to provide axial and rotational orientation of the lamp relative to the lamp base. The lamp heater conforms to the surface of the lamp and may be bonded thereto by an adhesive. The lamp heater may include a heater element and thermistor adjacent to a surface of the lamp. The lamp, lamp heater and thermistor are connected to a connector. A thermal breaker is connected to the heater. The thermal breaker provides a safety device to control maximum lamp temperature. The thermistor controls the operating temperature of the lamp. The lamp assembly may include a display device wherein the lamp is secured to the display device.

8 Claims, 6 Drawing Sheets

LAMP BASE HOUSING, WITH GEMINAL HALVES CONFIGURED TO ENGAGE A PRESS SEAL

CROSS-REFERENCES TO RELATED APPLICATIONS

This application discloses information claimed in Attorney's Docket Nos. 96-1-328 and 96-1-319, filed concurrently herewith.

1. Technical Field

The present invention relates to a lamp assembly useful with a display device such as, for example, an automobile instrument cluster panel.

2. Background Art

A lamp assembly has various uses in various industries. For example, a lamp assembly may be provided which includes a display device. Without limitation, an example of such a display device is an automobile instrument cluster panel. Such a panel typically contains 13 to 28 wedge base incandescent automotive lamps which serve as light sources for the panel. The bases of such lamps cause many problems. For example, typically such wedge base incandescent automotive lamps are made by one manufacturer and the sockets into which such lamps are inserted are made by another. When assembled, this can result in questionable reliability, varying coil robustness and limited life. In addition, there is a tendency for the contact wires of wedge base incandescent automotive lamps to flatten when subjected to vibration such as that normally incurred, for example, in an automotive environment. This can lead to intermittent or total lamp failure. In some automotive applications, such a wedge base lamp will actually inadvertently fall out of its socket and lay visible in the instrument cluster panel.

A further shortcoming is that such wedge base lamps operate at current levels of about 3.5 amps to 7.5 amps (50 to 105 watts), at temperature levels above 200° C. and provide only 5 to 8 lumens per watt. Such levels limit the design of the lamp envelopes available and the materials used in the fabrication thereof. Further, such hot lamps typically have a life expectancy of only 500 to 2500 hours at best. Such a limited lamp life expectancy is not consistent with present automotive warranties of 10 years/100,000 miles.

Incandescent lamps have been the primary light source for automotive lighting due to their ability to light in cold conditions. However, the use of a fluorescent lamp is known in the automotive art. For example, it is known to use a subminiature fluorescent U-shaped lamp as a light source in an automotive instrument cluster panel. A single insulative plastic base is used to house both ends of such U-shaped lamp as well as a header-type electrical connector provided for attachment to a controller circuit board. One disadvantage of such a base is that the electrical connections between the lamp and the connector, and the electrical connections between the connector and the circuit board, are typically effected by soldering. Such fluorescent lamps are also difficult to operate in cold environments.

DISCLOSURE OF THE INVENTION

It is an object of the present invention to provide an enhanced lamp assembly.

Another object of the present invention is to provide an improved lamp base housing.

Yet another object of the present invention is to provide such a lamp base housing which may be readily attached to the end of an elongated tubular lamp.

It is another object of the present invention to provide such a lamp base housing for use with a tubular lamp wherein the lamp base housing supports each end of the lamp and provides axial and rotational orientation of the lamp relative to the lamp base housing.

A further object of the present invention is to provide such a lamp base housing for use with a tubular lamp wherein identical base halves assemble together and are reversible for use at each lamp end.

Another object of the present invention is to provide such a lamp base housing for use with a lamp assembly wherein the lamp base housing provides a pocket for locating and retaining a thermal breaker associated with the lamp assembly.

Yet another object of the present invention is to provide such a lamp base housing for use with a lamp assembly wherein the lamp base housing provides paths and strain relief for conductors associated with the lamp assembly.

Still another object of the present invention is to provide such a lamp base housing for use with a tubular lamp wherein the lamp base housing facilitates assembling a lamp assembly into a display device.

This invention achieves the above and other objects by providing a lamp base housing for attachment to an end of a lamp having at least one lamp abutment region. The lamp base housing extends in the direction of a longitudinal axis from a first end to a second end and comprises a plurality of openings which extend in such direction from the first end to the second end. A first opening of the plurality of openings is configured to mate with an end of the lamp. The first opening has at least one first surface which comprises a mating abutment region configured to mate with at least one lamp abutment region.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figures 1, 2:
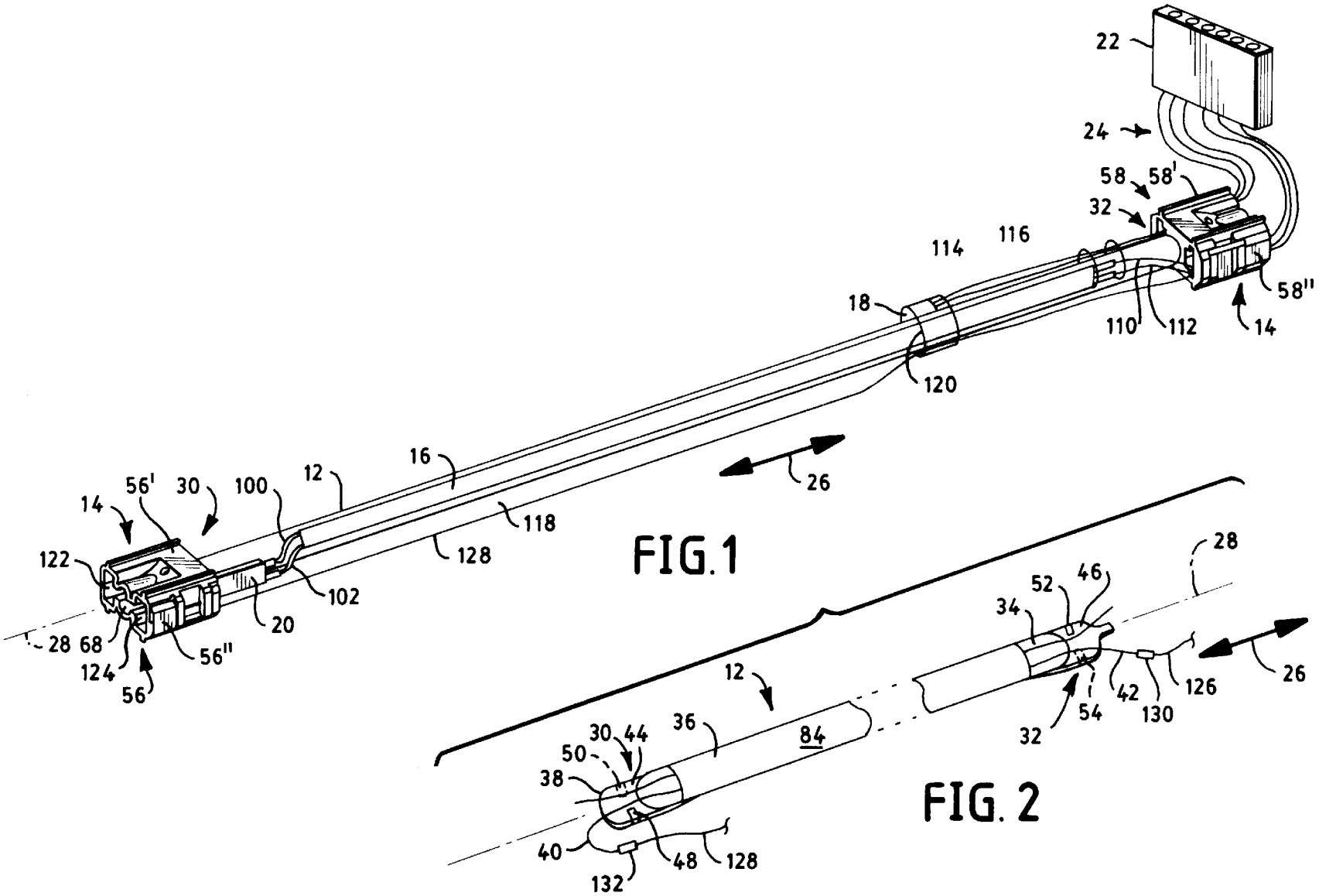
FIG. 1 is a perspective view of one embodiment of a lamp assembly of the present invention.
FIG. 2 is a perspective view of the lamp of FIG. 1.

FIG. 1 depicts a lamp assembly comprising lamp 12, insulative lamp bases 14 attached to the lamp, heater element 16 and thermistor 18 adjacent the lamp, thermal breaker 20 electrically and mechanically connected to the heater element, and connector 22 electrically and mechanically connected to the lamp, heater element and thermistor by conductors 24 illustrated as a wire harness.

Without limitation, the lamp assembly of FIG. 1 is a subminiature lamp assembly for use in automotive applications. It will be readily understood by those skilled in the art that the present invention is applicable to other types of lamp assemblies for use in other applications, and that the lamp of the present invention is not limited to any particular configuration or dimensions discussed herein.

In the embodiment depicted in FIGS. 1 and 2, and without limitation, lamp 12 is an arc discharge lamp such as a conventional cold cathode subminiature mercury arc discharge fluorescent lamp. Lamp 12 is elongated and tubular and extends in the direction 26 of a longitudinal axis 28 from a first end 30 to an opposite second end 32. Typically, a subminiature fluorescent lamp such as lamp 12 will include a glass tube 34, a phosphor coating 36 on the inside of the tube wall, a cathode end 38, and one or more lead wires 40, 42 extending from each tube end. Thermal breaker 20 is positioned in close proximity to lamp cathode end 38.

The subminiature fluorescent lamp 12 may be of the type which operates under 100° C. and provides at least about 25 lumens per watt compared to 5 to 8 lumens per watt provided by conventional incandescent lamps. Such lamp 12 typically will provide at least 8000 hours of lamp life and have a color temperature of about 5300° K. Lamp 12 is more robust than conventional incandescent lamps, lamp 12 having cathodes rather than coils. Lamp 12 is also very adaptable, such lamp being available in different colors and in different lengths. Without limitation, a typical lamp 12 will be about 300 mm in length and have a diameter of about 7 mm.

In the embodiment of FIG. 2, the ends 30 and 32 of lamp 12 include respective flat press seals 44 and 46 through which respective lead wires 40 and 42 extend in a conventional manner. The lamp of the present invention may be provided with one or more abutment regions. For example, in the embodiment of FIG. 2, press seal 44 of lamp 12 includes two abutment regions in the form of recesses 48 and 50 which extend into opposite surfaces at opposite edges of press seal 44. Similarly, press seal 46 includes two abutment regions in the form of recesses 52 and 54 which extend into opposite surfaces at opposite edges of press seal 46. Alternatively, recesses 48, 50, 52 and 54 may be in the form of protuberances which extend from respective press seals 44 and 46. The function of such abutment regions will be described hereinafter.

In the lamp assembly of the present invention, an insulative lamp base may be provided to which the lamp is attached. For example, in the embodiment of FIG. 1, there are two plastic insulative lamp bases 14 in the form of a first lamp base housing 56 and a second lamp base housing 58.

Lamp base housing 56 is mechanically attached to end 30 of lamp 12 and lamp base housing 58 is mechanically attached to end 32. In a preferred embodiment, lamp base housings 56 and 58 are identical, each including identical base halves 56',56" and 58', 58", respectively. Without limitation, lamp base halves 56',56" and 58',58" may be fabricated using conventional procedures. For example, such lamp base halves may be molded from a plastic material such as, without limitation, nylon or polypropylene. In a preferred embodiment, such plastic material is glass-filled PPA (polyphthalamide) which will be effective at temperatures of about −40° C. to 165° C.

Figure 3:
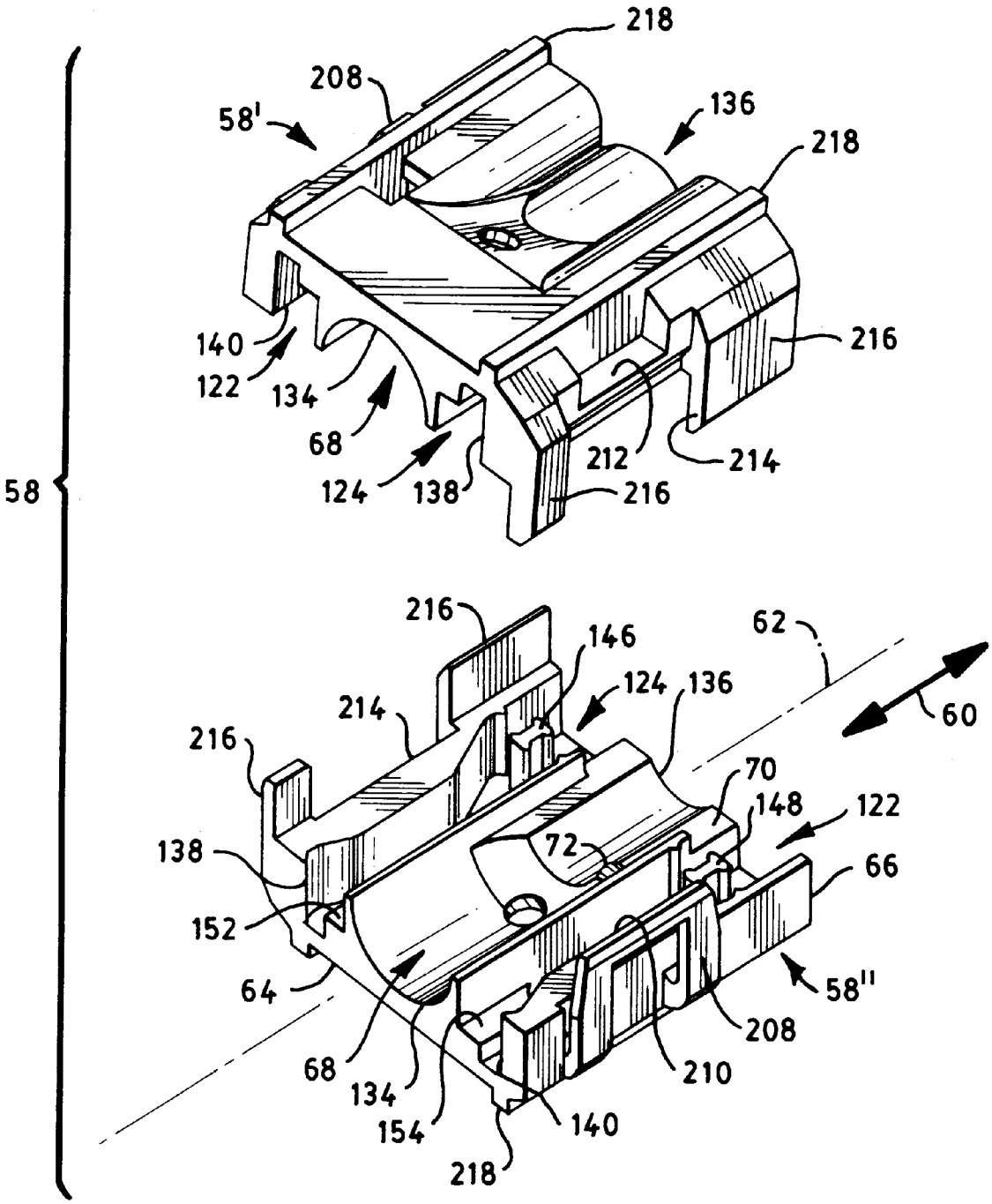
FIG. 3 is an exploded view of one embodiment of an insulative lamp base of the present invention.

In the embodiment of FIG. 3, one example of such a lamp base housing is illustrated. For purposes of illustration, lamp base housing 58 is depicted in FIG. 3, it being understood that lamp base housing 56 is identical thereto. Referring to FIG. 3, lamp base housing 58 extends in a direction 60 of a longitudinal axis 62 from a first end 64 to a second end 66. Lamp base housing 58 comprises a plurality of openings each of which extends in direction 60 from end 64 to end 66. One such opening 68, formed by connecting the two mechanically connecting base halves 58', 58" of lamp base housing 58, is configured to mate with end 32 of lamp 12 and comprises one or more surfaces having one or more abutment regions configured to mate with a respective abutment region of the lamp 12. For example, the portion of opening 68 of base half 58" depicted in FIG. 3 comprises a first surface 70 which comprises an abutment region which is configured to mate with a respective abutment region of press seal 46 as described hereinafter. Base half 58' comprises an identical abutment region (not shown). In those instances where the abutment regions of press seal 46 of lamp 12 are in the form of recesses 52, 54, the mating abutment regions of lamp base halves 58',58" will be in the form of mating protuberances 72, one such protuberance 72 of base half 58" being illustrated in FIG. 3. In those instances where protuberances are substituted for recesses 52, 54 of lamp 12, mating recesses will be substituted for protuberances 72 of lamp base halves 58',58". End 30 of lamp 12 will be inserted into and mate with an identical lamp base housing 56 in the same manner, protuberances 72 of lamp base halves 56',56" mating with respective recesses 48,50 of press seal 44. When using lamp base housings 56, 58 of the type depicted in FIG. 3, the ends 30, 32 of lamp 12 are inserted into respective openings 68 of respective lamp base housings 56, 58, the mating abutment regions providing axial and rotational orientation of the lamp relative to the lamp base housing. To this end, lamp ends 30, 32 are inserted into respective openings 68 of lamp base housings 56 and 58 such that each protuberance 72 of lamp base halves 56',56" mates with a respective recess 48, 50 of lamp 12, and each protuberance 72 of lamp base halves 58',58" mates with a respective recess 52, 54.

In the embodiment of FIG. 1, heater element 16 is positioned adjacent lamp 12 and has heater conductors electrically and mechanically connected thereto. Without limitation, heater element 16 may be in the form of a resistive foil heater which comprises one or more foil traces as described in more detail hereinafter. The thermistor 18 is also positioned adjacent lamp 12 and has thermistor conductors electrically and mechanically connected thereto. Thermal breaker 20 is electrically and mechanically connected to heater element 16.

Figure 4:
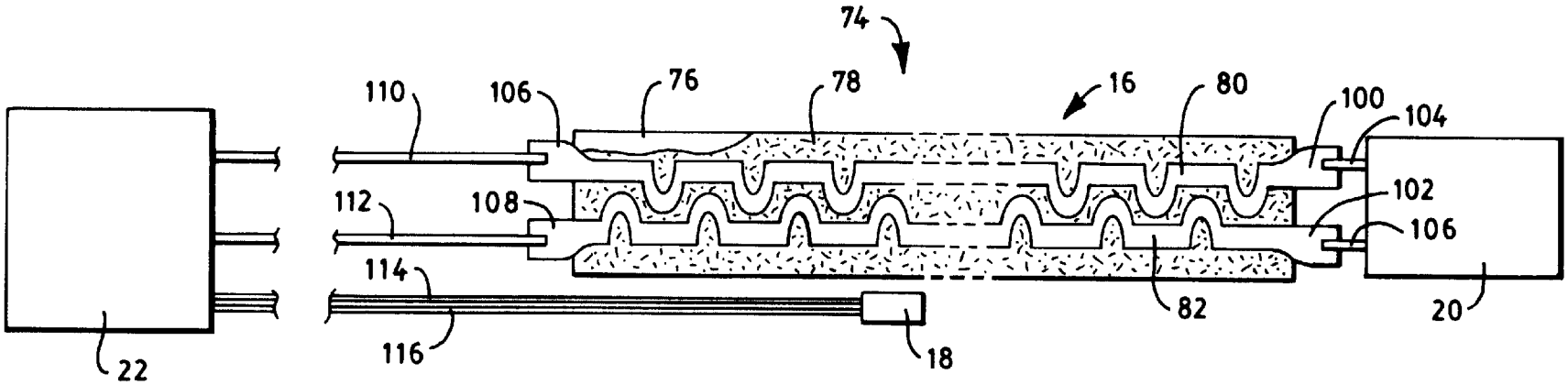
FIG. 4 is a plan view of one embodiment of a lamp heater of the present invention.

The heater element 16 and thermal breaker 20 may be electrically and mechanically connected together to form a lamp heater useful in practicing the present invention. Although useful in various applications, the lamp heater of the present invention is particularly useful in heating a subminiature fluorescent lamp useful, for example, in automotive applications. In such applications, the lamp heater of the present invention facilitates operation of a highly reliable and efficient low power (about 1.5 amps starting current, 0.6 amps operating current) integral single lamp assembly, such as the lamp assembly depicted in FIG. 1, in cold weather requirements. In a preferred embodiment, the heater element 16, thermistor 18, thermal breaker 20, and connector 22 are connected together to form one embodiment of an integral lamp heater of the present invention. Thermal breaker 20 provides a high temperature safety device, and thermistor 18 controls the degree of heat. An example of such a lamp heater is depicted in FIG. 4. In particular, a lamp heater 74 is provided which comprises a heating element 16 which comprises a backing material 76, a layer of bonding material 78 and lengths of foil traces 80 and 82 bonded to the bonding material. In a preferred embodiment, foil traces 80 and 82 have a somewhat serpentine pattern to increase the length and therefore the effective heating area of the traces. When used with a subminiature fluorescent lamp which is about 300 mm in length and about 7 mm in diameter a preferred length of a serpentine heater element 16 will be about 257 mm to 258 mm from end to end. In a preferred embodiment, backing material 76 is a flexible polyamide film sold by E. I. du Pont under its trademark KAPTON®, and bonding material 78 is a silicon pressure-sensitive adhesive sold by FLEXcon Company, Inc. of Spencer, Mass. under its trademark DENSIL®. In a preferred embodiment, the KAPTON® polyamide film is purchased with the DENSIL® bonding material coated thereon, and the foil traces 80,82 are adhered to such coated substrate which may then be adhered directly to lamp surface 84. The flexible KAPTON® substrate is conformable to the rounded surface 84 of the tubular lamp 12. The DENSIL® adhesive is particularly useful at elevated lamp temperatures. A preferred form of the DENSIL® adhesive is flame retardant and thermally conductive. The resistance heater element 16 described herein operates at an input of about 13.5 volts D.C., with an operating range of about 9.0 to 16.0 volts D.C. Maximum operating current is about 2 amps and resistance is about 17.69 Ohms±10% (10.3 watts reference). Such a lamp element 16 has an ambient operating temperature of about −40° C. to 159° C. and a storage temperature of about −40° C. to 165° C. The life of such lamp is about 10,000 hours, and it has a high UV rating.

Figure 5:
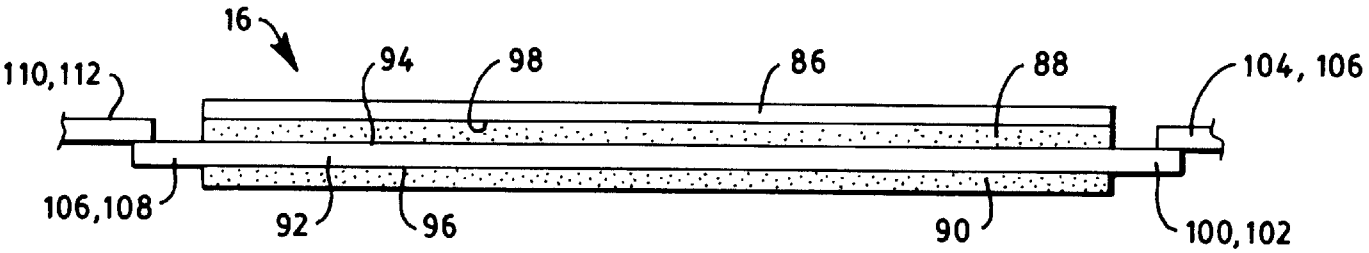
FIG. 5 is a diagrammatic representation of one embodiment of a heating element of the present invention.

In an alternative embodiment diagrammatically depicted in FIG. 5, the heating element 16 is illustrated as comprising a backing material 86, and layers of bonding materials 88 and 90 with lengths of foil traces therebetween. Only one foil trace 92 is depicted in FIG. 5. Foil trace 92 has a first surface 94 a second surface 96. Bonding material 88 is in contact with an inner surface 98 of the backing material 86. Surface 94 of foil trace 92 is in contact with bonding material 88 and is thereby adhered to the inner surface 98 of the backing material 86. In addition, surface 96 of foil trace 92 is in contact with bonding material 90 which serves to bond the heating element 16 to the lamp 12 such that the heating element is substantially contiguous with a portion of surface 84 of the lamp. With reference to FIG. 4, the thermal breaker 20 is electrically and mechanically connected in series to the length of foil traces 80 and 82. To this end, foil traces 80 and 82 include respective tabular end segments 100 and 102 which are soldered or welded to respective leads 104 and 106 of the thermal breaker 20. Thermal breaker 20 is placed in close proximity to the high heat source lamp cathode end 38. Thermal breaker 20 controls the maximum temperature of lamp 12, and in a preferred embodiment includes a resettable safety switch. In this manner, a safety device is provided to the extent that if the lamp temperature rises above a normal operating temperature, the thermal breaker opens thereby breaking heater continuity until such temperature drops below the operating temperature at which time the thermal breaker closes again to allow the resumption of heater continuity. A thermal breaker sold by Texas Instruments, Inc. of Attleboro, Mass. under catalogue no. 6MM01AA has been found to be particularly useful in the lamp heater of the present invention. The input of such thermal breaker is about 13.5 volts, and the current is about 4 amps (maximum inrush) and about 2 amps (maximum operating). The temperature ratings are about 75° C.±10° C. (switch temperature), −40° C. to 105° C. (operating temperature) and −40° C. to 165° C. (storage temperature). The preferred style is 6 mm without nickel strips. Such thermal breaker measures about 3 mm×6 mm×18.5 mm and fits nicely within the lamp base housing 56 as described herein.

Connector 22 is electrically and mechanically connected to the length of foil traces 80 and 82 and to the thermistor 18. To this end, foil traces 80 and 82 include respective tabular end segments 106 and 108 which are soldered or welded to one end of respective conductors 110 and 112. The other end of conductors 110 and 112 are electrically and mechanically connected to connector 22 in a conventional manner.

Thermistor 18 comprises thermistor conductors 114 and 116 which are also electrically and mechanically connected to the connector 22 in a conventional manner.

In the embodiment of FIG. 1 the thermistor 18 is attached directly on the lamp 12 by tape 120. Tape 120 may be high temperature and optically clear so as not to interfere with the illumination of lamp 12. Thermistor 18 controls the operating temperature of lamp 12 in a conventional manner to stabilize lamp temperature at its operating temperature. A thermistor sold by Inter-Technical Group, Inc. of Elmsford, N.Y. under catalogue no. Uppermost #NA1036K1B-160(03) (Type NTC) has been found to be particularly useful in the lamp heater of the present invention. The resistance of such thermistor is about 10K Ohms±10% at 25° C. and about 3K Ohms±10% at 55° C. The temperature coefficient of resistance at 25° C. is about −44%/°C., and the thermal time constant is above 25 seconds maximum. The operating temperature is about −40° C. to 105° C. and the storage temperature is about −40° C. to 165° C. The lead wire is 24–28 gage with about 1.25 mm maximum insulation. When used with a subminiature fluorescent lamp 12 having a length of about 300 mm and a width of about 7 mm, such a thermistor is positioned about 100 mm from the distal end of end 32 of the lamp.

The embodiment of the lamp heater of the present invention described herein and depicted in FIGS. 4 and 5 allows a subminiature mercury arc discharge fluorescent lamp to be readily heated up to and stabilized at its operating temperature, even in automotive applications which may be subjected to cold temperatures. Such a heater assembly provides a simplified, compact assembly with a minimum number of wire connections. It must be emphasized that the lamp heater of the present invention is not limited to use with the lamp type, size or configuration described herein. Regardless of the application, a zero maintenance, long life lamp assembly is provided in accordance with the present invention.

In the lamp assembly depicted in the drawings, each lamp base housing 56 and 58 comprises an opening 122 and an opening 124 as depicted with respect to lamp base housing 56 in FIG. 1. As depicted in more detail in FIG. 3, openings 122 and 124 each extend in direction 60 from end 64 to end 66, and opening 68 is positioned between openings 122 and 124.

In the embodiment of FIG. 2, lead wires 42 and 40 of lamp 12 are electrically and mechanically connected to lamp conductors 126 and 128, respectively, in a conventional manner. For example, lead wires 42 and 40 are spliced to lamp conductors 126 and 128 at 130 and 132, respectively. Lamp conductor 128 may be fastened to lamp 12 by tape 120 as depicted in FIG. 1. Lamp conductors 126, 128, heater conductors 110,112 and thermistor conductors 114,116 are electrically and mechanically connected to connector 22 in a conventional manner.

In the lamp assembly of the present invention, the thermal breaker extends into and is held in place by an insulative base housing. For example, in the embodiment of FIG. 1, the thermal breaker 20 extends into opening 124 and is held in place by the lamp base housing 56 as described in more detail hereinafter.

In the lamp assembly of the present invention, the various conductors extend through one or more of the lamp base housings. For example, in the embodiment of FIG. 1, heater conductors 110,112, thermistor conductors 114,116 and lamp conductors 126,128 extend through the lamp base housing 58 to the connector 22. Lamp conductor 128 also extends through lamp base housing 56. The orientation of such conductors will be described in more detail hereinafter.

Figure 6:
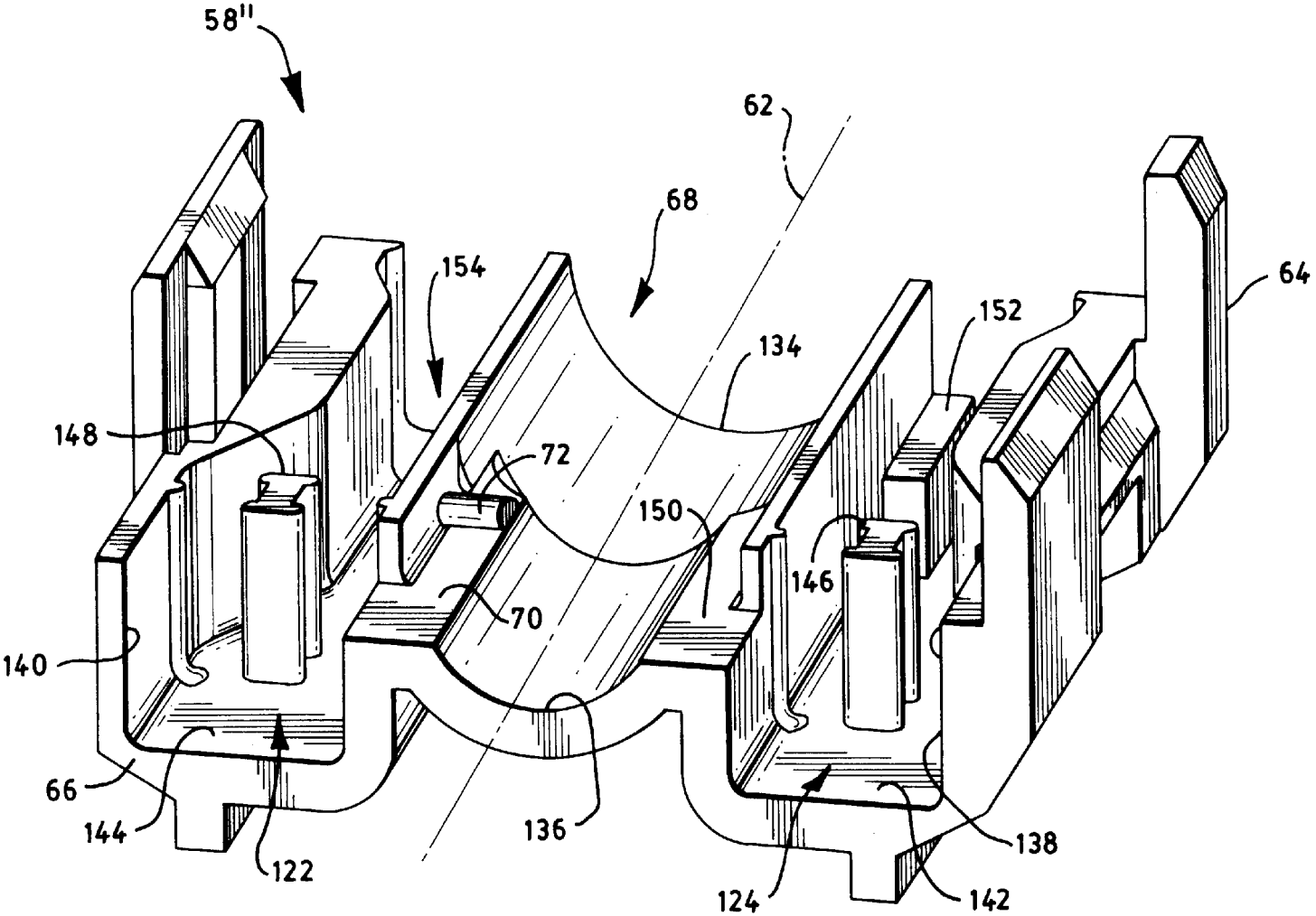
FIG. 6 is a perspective view of one lamp base half of the insulative lamp base of FIG. 3.
Figure 7:
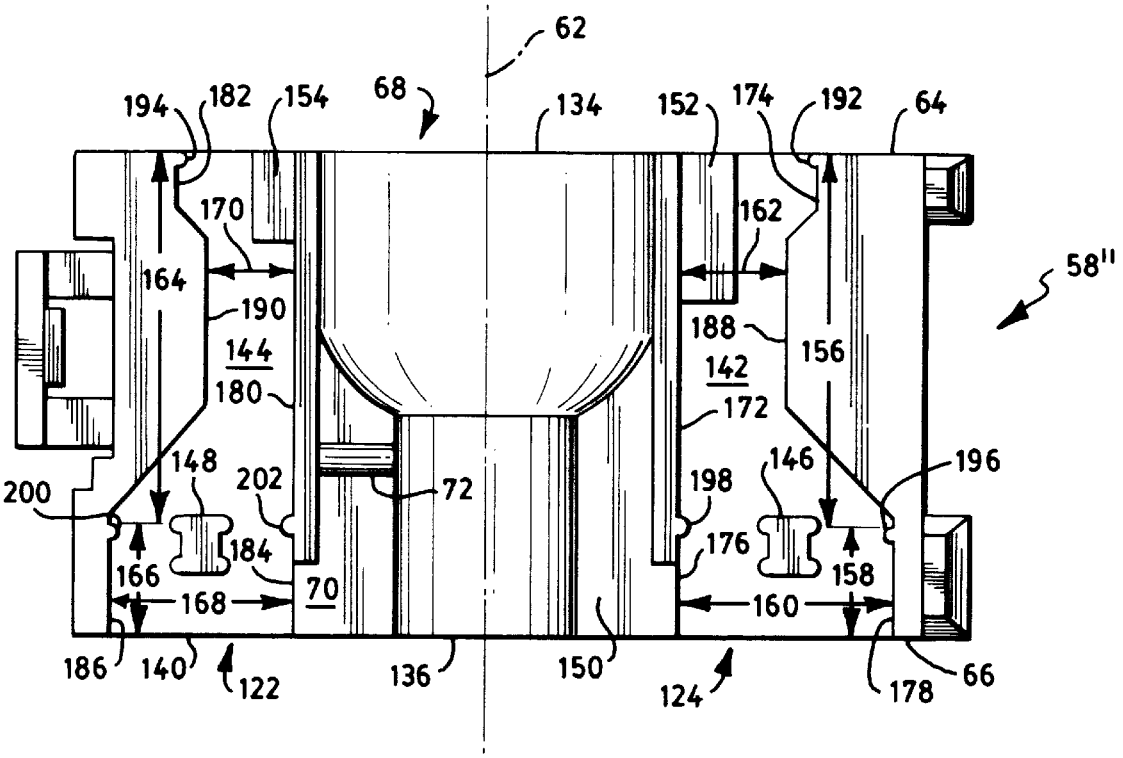
FIG. 7 is a plan view of the lamp base half of FIG. 6.

FIG. 6 is an enlargement of lamp base half 58" of FIG. 3, viewed from end 66. FIG. 7 is a plan view of FIG. 6. Lamp base halves 58', 56' and 56" are identical to lamp base half 58". Lamp base half 58", and lamp base half 58', each comprise a portion of opening 68, a portion of opening 122 and a portion of opening 124. When lamp base halves 58',58" are connected together, respective portions form respective openings 68, 122 and 124. The portion of the opening 68 of each lamp base half 58" comprises a first recess 134 which extends from end 64 towards end 66 and a second recess 136 which extends from end 66 towards end 64 and opens into recess 134. The surface 70 is adjacent recess 136. It will be apparent from FIG. 3 that each recess 134,136 of lamp base half 58" will be aligned with a respective recess 134,136 of lamp base half 58' when lamp base halves 58' and 58" are connected together to form opening 68.

As noted, lamp base half 58" comprises a portion of openings 122 and 124. In particular, the portion of openings 124 and 122 of each lamp base half 58" comprises respective recesses 138 and 140 which extend from end 64 to end 66. It will be apparent from FIG. 3 that each recess 138 and 140 of lamp base half 58" will be aligned with a respective recess 140 and 138 of lamp base half 58' when lamp base halves 58" and 58' are connected together to form openings 122 and 124 as described hereinafter. Each recess 138,140 comprises a respective base 142,144 and a respective protuberance 146,148 extending therefrom. In the embodiment of FIG. 6, protuberances 146,148 are in the form of posts. Recess 136 extends between surface 70 and an opposite surface 150 such that surface 70 is adjacent recesses 136 and 140, and surface 150 is adjacent recesses 136 and 138. Since lamp base halves 58' and 58" are identical, it will be apparent from FIG. 3 that when they are connected together, protuberance 72 of lamp base half 58" will face surface 150 of lamp base half 58', and protuberance 72 of lamp base half 58' will face surface 150 of lamp base half 58". In this manner, when assembled as depicted in FIG. 1, a protuberance 70 of lamp base halves 56',56" and 58',58" will extend into a respective recess 48,50,52 and 54 of lamp 12. In the embodiment depicted in the drawings, surfaces 70 and 150 of lamp base halves 56', 56" and 58', 58" are configured to engage a respective surface of a respective press seal 44,46 of lamp 12 depicted in FIG. 2. In addition, each recess 134 is configured to substantially conform to, engage and thereby support a respective tubular lamp end portion adjacent press seals 44,46. In the embodiment of FIGS. 3, 6 and 7, recess 138 comprises a protuberance 152 and recess 140 comprises a protuberance 154 extending from respective bases 142 and 144.

As best depicted in FIG. 7, the recess 138 comprises a region 156 which extends from end 64 towards end 66 and a region 158 which extends from end 66 towards end 64 and opens into region 156. Region 158 has a width 160 which is greater than a width 162 of region 156, the protuberance 146 being positioned in region 158 and the protuberance 152 being positioned in region 156. Similarly, recess 140 comprises a region 164 which extends from end 64 towards end 66 and a region 166 which extends from end 66 towards end 64 and opens into region 164. Region 166 has a width 168 which is greater than a width 170 of region 164, the protuberance 148 being positioned in region 166 and the protuberance 154 being positioned in the region 164. Region 156 comprises opposing wall segments 172, 174 which extend vertically from base 142, and region 158 comprises opposing wall segments 176,178 which extend vertically from base 142. The protuberance 146 is substantially centered between wall segments 176,178, and the protuberance 152 is positioned against wall segment 172. Similarly, region 164 comprises opposing wall segments 180, 182 which extend vertically from base 144, and region 166 comprises opposing wall segments 184,186 which extend vertically from base 144. The protuberance 148 is substantially centered between wall segments 184,186, and the protuberance 154 is positioned against wall segment 180. Wall segments 174 and 182 comprise a length 188,190, respectively, which protrude towards respective wall segments 172,180. Protuberances 192,194 extend from respective wall segments 174,182 towards a protuberance 152,154, respectively. Protuberances 196,198 extend from respective wall segments 178,176 towards protuberance 146, and protuberances 200,202 extend from respective wall segments 186,184 towards protuberance 148.

Figure 8:
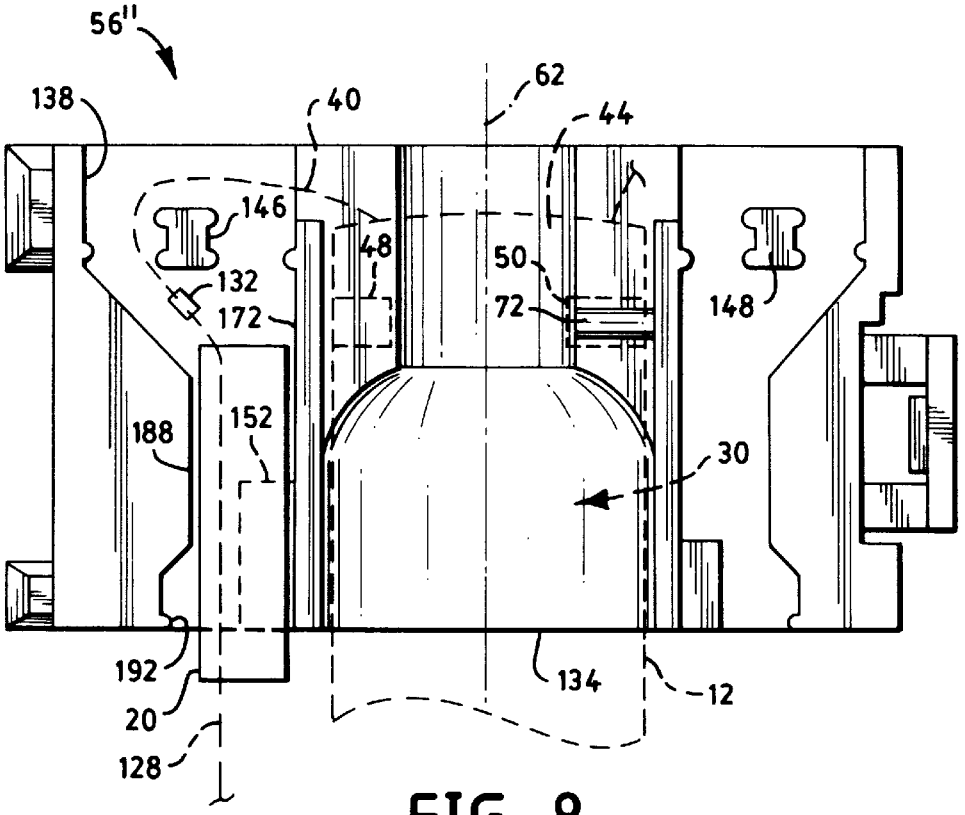
FIG. 8 is a plan view of one embodiment of one lamp base half of the present invention having (a) one end of a lamp (in phantom lines); (b) a thermal breaker; and (c) a lamp conductor (in phantom lines), shown mounted therein.
Figure 9:
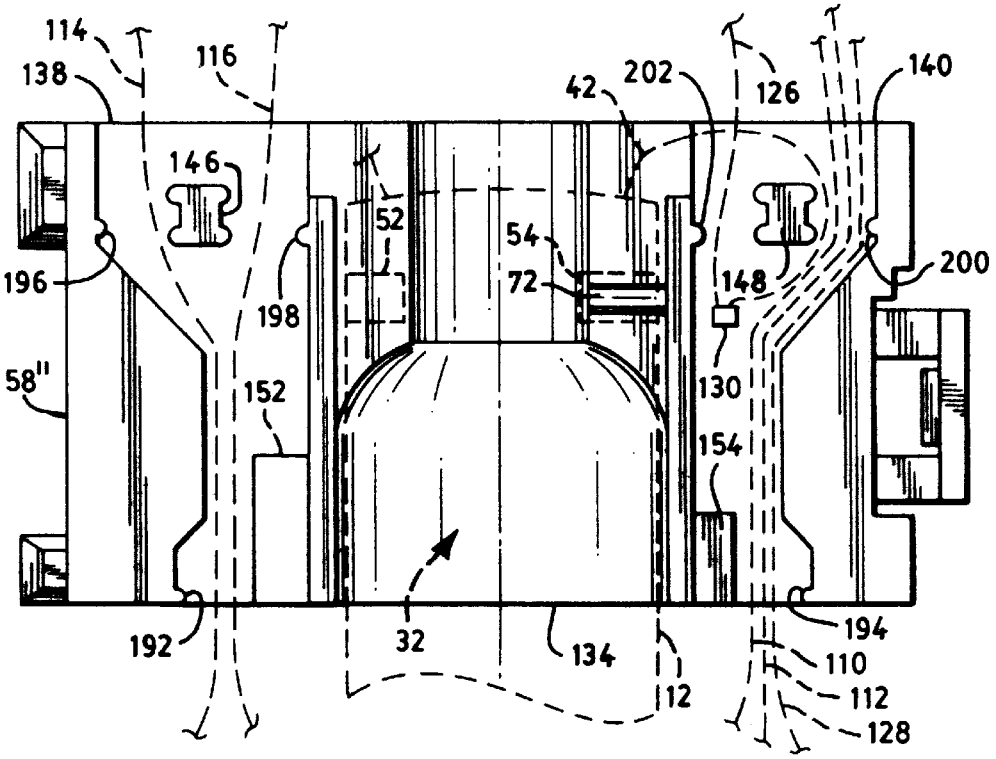
FIG. 9 is a plan view of a lamp base half of the type depicted in FIG. 8 having (a) an opposite end of a lamp (in phantom lines) and (b) a plurality of conductors (phantom lines), shown mounted therein.

In considering assembling the lamp assembly depicted in the drawings, the lamp heater is attached to lamp 12 by adhesively bonding the heater element 16, and taping the thermistor 18, to surface 84 of the lamp, as described herein. With reference to FIG. 8, the end 30 of the lamp 12 is then inserted into a lamp base half 56", which is identical to lamp base half 58", such that recess 134 supports a tubular end portion of the lamp and the protuberance 72 of lamp base half 56" protrudes into recess 50 of the lamp. To this extent, such mating protuberance 72/recess 50 serves to properly locate the end 30 of lamp 12 relative to the lamp base half 56". The lead wire 40 and lamp conductor 128 spliced thereto at 132 are wrapped around a protuberance such as, for example, protuberance 146, and the lamp conductor 128 is extended through the recess 138 such that the lamp conductor 128 is wedged between, and held in place by, facing surfaces of protuberances 152 and 192. All of the conductors depicted in FIGS. 8 and 9 are illustrated as single phantom lines for clarity of the drawings. However, it will be understood by those skilled in the art that such conductors will have a diameter. In the embodiment of FIG. 8, conductor 128 may have a diameter slightly greater than the distance between protuberances 152 and 192 allowing such wedging to be effected. Subsequently, the thermal breaker 20 is inserted into recess 138 by inserting the thermal breaker between wall segment 172 and wall length 188 until the thermal breaker rests upon the protuberance 152. When lamp 12, lamp conductor 128 and thermal breaker 20 are in place within lamp base half 56", an identical mating lamp base half 56' is fastened in place relative to lamp base half 56", as depicted in FIG. 3, to thereby enclose (a) the end 30 of lamp 12 within opening 68 and (b) the lengths of lamp conductor 128 and thermal breaker 20 within opening 124. When lamp halves 56', 56" are connected together, protuberance 72 of lamp base half 56' will extend into lamp recess 48. In addition, a portion of the thermal breaker 20, which will be extending out of the lamp base half 56", will extend into recess 140 of lamp base half 56' between wall segment 180 and wall length 190, and engage protuberance 154. Protuberances 152 and 192 provide strain relief for lamp conductor 128, and protuberance 146 provides a guide for lead wire 40 and lamp conductor 128 welded thereto.

With reference to FIG. 9, the end 32 of lamp 12 is inserted into a lamp base half 58" such that recess 134 supports a tubular end portion of the lamp and the protuberance 72 of lamp base 58" protrudes into recess 54 of lamp 12. To this end, such mating protuberance 72/recess 54 serves to properly locate the end 32 of lamp 12 relative to the lamp base half 58". The lead wire 42 and lamp conductor 126 spliced thereto at 130 are wrapped around a protuberance such as, for example, protuberance 148, and the lamp conductor 126 is extended through a portion of the recess 140 such that the lamp conductor 126 is wedged between, and held in place by, protuberances 148 and 202 by providing a conductor having a diameter slightly greater than the distance between protuberance 148 and 202. Subsequently, lamp conductor 128, which extends from end 30 of lamp 12, and heater conductors 110,112 are inserted into recess 140 and wedged between protuberances 148 and 200. Although FIG. 9 depicts conductors 110,112 and 128 side by side for clarity of the drawing, in the preferred embodiment such conductors will be stacked upon each other so that each such conductor may be similarly wedged between protuberances 148 and 200. Thermistor conductors 114,116 will then be inserted into recess 138 such that conductor 114 is similarly wedged between protuberances 146 and 196, and conductor 116 is similarly wedged between protuberances 146 and 198. Conductors 110,112 and 128 will also be wedged between protuberances 154,194 and conductors 114,116 will also be wedged between protuberances 152,192.

When the conductors 110, 112, 114, 116, 126 and 128 are in place within lamp base half 58", a mating lamp base half 58' is fastened in place relative to lamp base half 58", to thereby enclose (a) the end 32 of lamp 12 within opening 68, (b) the lengths of conductors 110, 112, 126 and 128 within opening 122, and (c) the lengths of conductors 114 and 116 within opening 124. In addition, when lamp base halves 58'58" are coupled together, protuberance 72 of lamp base 58' will extend into lamp recess 52. Protuberances 146 and 148 provide guides for respective conductors as depicted in FIG. 9. Further, as depicted in FIG. 9, strain relief is provided by protuberances 146, 196 for conductor 114; by protuberances 146, 198 for conductor 116; by protuberances 152, 192 for conductors 114, 116; by protuberances 148, 202 for conductor 126; and by protuberances 148, 200 and 154, 194 for conductors 110, 112 and 128.

In order to connect the lamp base halves together, each lamp base half comprises a clip member and a mating clip member which are connectable together. For example, with reference to FIG. 3, lamp base half 58" comprises a flexible conventional clip member 208 having a locking edge 210 which snaps into place relative to a latch locking ledge 212 of a mating clip member 214 of lamp base half 58'. Lamp base half 58' comprises a similar flexible clip member 208, only partially seen in FIG. 3, and lamp base half 58" comprises a similar mating clip member 214. Self-alignment tabs 216 are provided to facilitate alignment of each clip member 208 with a respective mating clip member 214. Guide arms 218 are provided for facilitating positioning each lamp base housing 56,58 relative to a support surface. Conductors 110, 112, 114, 116, 126 and 128 extend from lamp base housing 58 to connecter 22 which provides a common connector head for such conductors.

Figure 10:
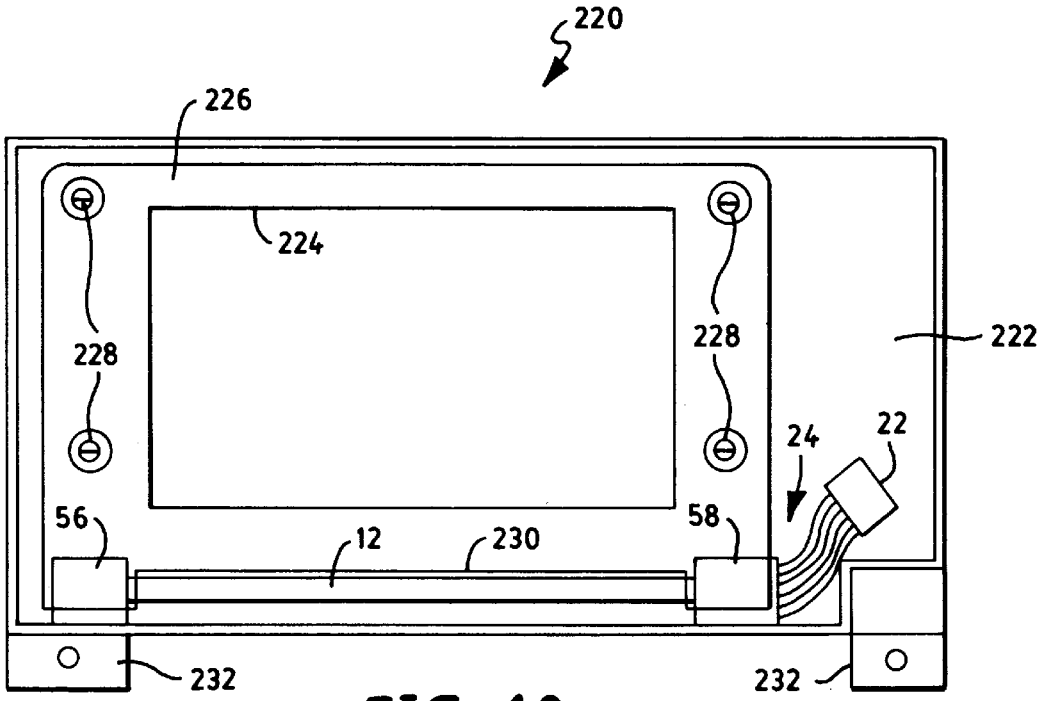
FIG. 10 is a plan view of another embodiment of a lamp assembly of the present invention.

In one embodiment of the lamp assembly of the present invention a display device is provided. Without limitation, such a lamp assembly is particularly useful when such display device is in the form of an automobile cluster panel. For example, in the embodiment illustrated in FIG. 10, a display device 220 is provided having a lamp 12 secured thereto. To this end, the lamp base housings 56,58 are secured to the display device to hold lamp 12 in place relative to the display device. In particular, the display device 220 comprises a display device housing 222, having an opening 224, and a clear plastic display panel 226 attached to the display device housing. Lamp 12 is positioned between the display device housing 222 and the display panel 226. In particular, the first and second lamp base housings 56 and 58 are sandwiched between the display device housing 222 and display panel 226, and screws 228 secure the package together. In the embodiment of FIG. 10, lamp 12 is positioned adjacent an edge 230 of the display panel 226, and the display panel may be mounted to the dashboard of a vehicle at mounts 232 in a conventional manner.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A lamp base housing, comprising connecting first and second base members, each base member extending in the direction of a linear axis from a first end to an opposite second end, each base member comprising a first opening structured and arranged for insertion therein of portions of an end of an elongated tubular lamp and comprising:

a first recess extending in said direction from said first end towards said second end and structured and arranged to mate with a tubular portion of an elongated tubular lamp;

a second recess extending in said direction from said second end towards said first end and structured and arranged to mate with a press seal portion of an elongated tubular lamp, said second recess opening into said first recess, and;

at least one first surface extending in said direction adjacent said second recess, said at least one first surface comprising one of a protrusion and an indentation structured and arranged to engage a respective one of an indentation and a protrusion of a press seal portion of an elongated tubular lamp.

2. The lamp base housing of claim 1 wherein said first and second base halves each comprises a clip member and a mating clip member, said clip members of said first and second base halves being connectable to respective mating clip members of said second and first base halves, respectively.

3. The lamp base housing of claim 1 further including a second opening which comprises a third recess and a third opening which comprises a fourth recess, said third and fourth recesses each extending in said direction from said first end to said second end, said first recess and said second recess extending between said third recess and said fourth recess.

4. The lamp base housing of claim 3 wherein said third recess comprises a third recess base and further includes a first protuberance extending into said third recess from said third recess base to a first abutment surface, and said fourth recess comprises a fourth recess base and further includes a second protuberance extending into said fourth recess from said fourth recess base to a second abutment surface, said second and third openings each being structured and arranged for insertion therein of at least a portion of a thermal breaker, said first abutment surface and said second abutment surface being adjacent said first end and structured and arranged to engage therebetween opposite surface portions of a thermal breaker, inserted in said first end, when said first and second base members are connected to each other.

5. The lamp base housing of claim 4 wherein said third recess and said fourth recess each comprise a first region extending from said first end towards said second end and a second region extending from said second end towards said first end, said second region opening into said first region, said second region having a width which is greater than a width of said first region, said first protuberance being positioned in said first region of said third recess and said second protuberance being positioned in said first region of said fourth recess.

6. The lamp base housing of claim 5 wherein said first region of said second opening comprises a first wall segment and an opposite second wall segment, said first protuberance extending into said third recess from said first wall segment, and said second wall segment including at least a length which extends into said third recess towards said first wall segment, and further wherein said first region of said third opening comprises a third wall segment and an opposite fourth wall segment, said second protuberance extending into said fourth recess from said third wall segment, and said fourth wall segment including at least a length which extends into said fourth recess towards said third wall segment.

7. The lamp base housing of claim 6 wherein said second region of said second opening comprises a third protuberance extending into said third recess from said third recess base intermediate of opposing wall portions of said third recess, and further wherein said second region of said third opening comprises a fourth protuberance extending into said fourth recess from said fourth recess base intermediate of opposing wall portions of said fourth recess.

8. The lamp base housing of claim 7 wherein said second region of said second opening comprises opposing fifth and sixth protuberances extending towards each other into said third recess from respective wall portions of said opposing wall portions of said third recess, said third protuberance being intermediate of said opposing fifth and sixth protuberances, and further wherein said second region of said third opening comprises opposing seventh and eighth protuberances extending towards each other into said fourth recess from respective wall portions of said opposing wall portions of said fourth recess, said fourth protuberance being intermediate of said opposing seventh and eighth protuberances.

* * * * *